US007873314B2

(12) United States Patent
Sakanobe et al.

(10) Patent No.: US 7,873,314 B2
(45) Date of Patent: Jan. 18, 2011

(54) CLEANING MEMBER, CLEANER, IMAGE CARRIER UNIT AND IMAGE FORMING DEVICE

(75) Inventors: Makoto Sakanobe, Kanagawa (JP); Hiroaki Akamatsu, Kanagawa (JP); Yuichi Fukuda, Kanagawa (JP); Ryosuke Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 40 days.

(21) Appl. No.: 12/370,250

(22) Filed: Feb. 12, 2009

(65) Prior Publication Data

US 2010/0054831 A1 Mar. 4, 2010

(30) Foreign Application Priority Data

Sep. 2, 2008 (JP) ..... P2008-225181

(51) Int. Cl.
*G03G 21/00* (2006.01)

(52) U.S. Cl. ..... 399/351

(58) Field of Classification Search ..... 399/107, 399/110, 123, 343, 350, 351; 15/256.25, 15/256.51

See application file for complete search history.

(56) References Cited

U.S. PATENT DOCUMENTS 5,363,182 A * 11/1994 Kuribayashi et al. ..... 399/350
5,460,674 A * 10/1995 Chitouras ..... 156/94
7,184,699 B2 * 2/2007 Naruse et al. ..... 399/350
7,720,426 B2 * 5/2010 Watanabe et al. ..... 399/350

FOREIGN PATENT DOCUMENTS

JP 05-273897 10/1993
JP 06-348192 12/1994

* cited by examiner

*Primary Examiner*—Hoan Tran
(74) *Attorney, Agent, or Firm*—Morgan, Lewis & Bockius LLP

(57) ABSTRACT

A cleaning member includes a cleaning part whose one end portion comes into contact with a surface of an image carrier, and a supporting part that supports the cleaning part and applies a force for pressing the one end portion of the cleaning part to the surface of the image carrier, wherein a surface of a first portion including the one end portion of the cleaning part is bonded to the supporting part with a first adhesive layer, and a surface of a second portion including the other end portion opposite to the one end portion of the cleaning part is bonded to the supporting part with a second adhesive layer having a Type-A durometer hardness which is lower than that of the first adhesive layer.

14 Claims, 4 Drawing Sheets

CLEANING MEMBER, CLEANER, IMAGE CARRIER UNIT AND IMAGE FORMING DEVICE

CROSS-REFERENCE TO RELATED APPLICATION

This application is based on and claims priority under 35 USC 119 form Japanese Patent Application No. 2008-225181 filed Sep. 2, 2008.

BACKGROUND

1. Technical Field

The present invention relates to a cleaning member, a cleaner, an image carrier unit and an image forming device.

2. Related Art

In an image forming device such as an electro-photographic type copying machine or a printer, after a visible image on the surface of an image carrier such as a photosensitive member is transferred to a member to which the visible image is transferred such as a recording medium or an intermediate transfer member, a developer remaining on the surface of the image carrier is removed by a cleaner.

SUMMARY

According to an aspect of the invention, a cleaning member includes a cleaning part whose one end portion comes into contact with a surface of an image carrier, and a supporting part that supports the cleaning part and applies a force for pressing the one end portion of the cleaning part to the surface of the image carrier, wherein a surface of a first portion including the one end portion of the cleaning part is bonded to the supporting part with a first adhesive layer, and a surface of a second portion including the other end portion opposite to the one end portion of the cleaning part is bonded to the supporting part with a second adhesive layer having a Type-A durometer hardness which is lower than that of the first adhesive layer.

According to the aspect of the invention, the variation of a contact pressure of a cleaning member and an image carrier due to an environmental change may be more suppressed than a case that does not have a structure of the present invention.

BRIEF DESCRIPTION OF THE DRAWINGS

Exemplary embodiments of the invention will be described in detail based on the following figures, wherein.

DETAILED DESCRIPTION

Figure 1:
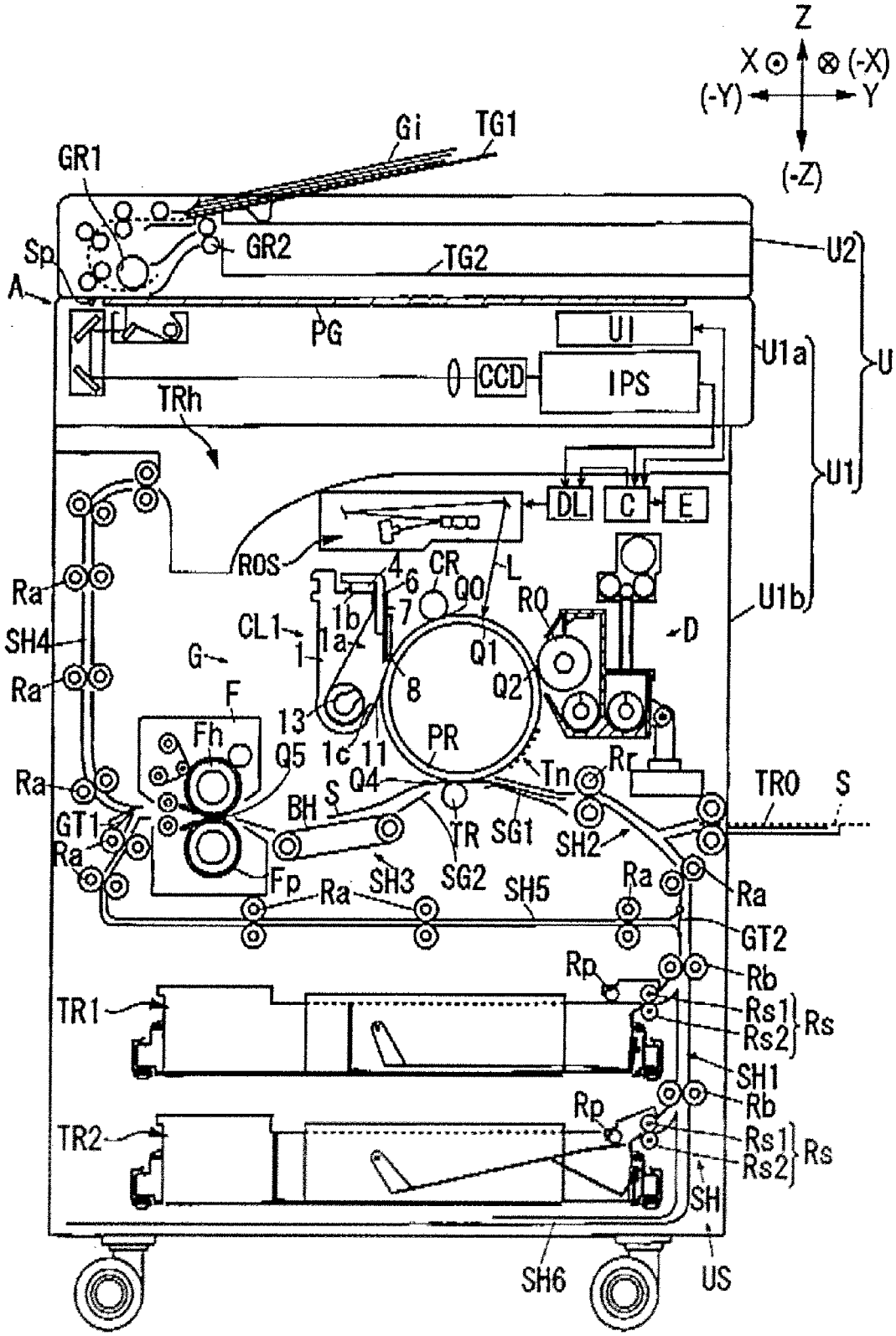
FIG. 1 is an entire explanatory view and a sectional view of an image forming device of a first embodiment of the present invention.

Now, referring to the drawings, an embodiment as a specific exemplary embodiment of a best mode of the present invention will be described below, however, the present invention is not limited to a below-described embodiment.

For the purpose of easily understanding a following description, in the drawings, a forward and rearward diction is designated as an X-axis direction, a rightward and leftward direction is designated as a Y-axis direction and an upward and downward direction is designated as a Z-axis direction, and sides respectively shown by arrow marks X -X, Y, -Y, Z and -Z designate forward, rearward, rightward, leftward, upward and downward or a forward side, a rearward side, a rightward side, a leftward side, an upward side and a downward side.

Further, in the drawings, "O" in which "." is written means an arrow mark directed to a front side from a back side of a sheet surface and "O" in which "x" is written means an arrow mark directed to a back side from a front side of a sheet surface.

First Embodiment

FIG. 1 is an entire explanatory view and a sectional view of an image forming device of a first embodiment of the present invention.

In FIG. 1, the image forming device U includes a digital copying machine main body U1 as an example of an image forming device main body having on an upper surface a transparent document base, what is called a platen glass PG and an automatic document feeder U2 detachably attached on the platen glass PG.

The automatic document feeder U2 includes a document feeding part TG1 in which plural original documents Gi to be copied are stacked and accommodated. The plural the original documents Gi mounted on the document feeding part TOG are respectively and sequentially allowed to pass a copying position on the platen glass PG, that is, a pressure contact position of a platen roll GR1 as an example of a document feeding member and output to a document exit part TG2 by a document exit member GR2.

The copying machine main body U1 includes a scanner part U1*a* as an example of an image reading device having the platen glass PG and a printer part U1*b* as an example of an image recording device.

The scanner part U1*a* has a detecting member of a position of an exposure system arranged at a reading reference position, what is called an exposure system registration sensor Sp and an exposure optical system A.

The exposure optical system A whose movement and stop are controlled by a detecting signal of the exposure system registration sensor Sp is ordinarily stopped at the reading reference position.

In an automatic document feeding operation that a copying operation is carried out by using the automatic document feeder U2, the exposure optical system A exposes the original documents Gi respectively sequentially passing the copying position on the platen glass PG under a state that the exposure optical system A is stopped at the ring reference position.

In a manual document setting operation that the document Gi is manually placed on the platen glass PG by an operator to carry out the copying operation, the exposure optical system A moves, and exposes and scans the document Gi on the platen glass PG at the same time.

A reflected light from the exposed document Gi passes through the exposure optical system A and is converged on a solid state image sensor CCD. The solid state image sensor CCD converts the light reflected from the document and converged on its image sensing surface to an electric signal.

An image processing part IPS converts a reading image signal inputted from the solid state image sensor CCD to a digital image writing signal and outputs to a writing signal output device DL of the printer part U1*b*.

The writing signal output device DL whose operation tiring is controlled by a control part C of the printer part U1*b* outputs a writing signal corresponding to inputted image data to a latent image writing device ROS.

In a lower part of the latent image writing device ROS, a rotating image carrier PR is arranged. Ater the surface of the image carrier PR is charged by a charging roll CR as an example of a charger in a charging area Q0, the surface of the image carrier is exposed and scanned by a laser beam L as an example of a latent image writing light of the latent image writing device ROS in a latent image writing position Q1 to form an electrostatic latent image. The surface of the image carrier PR on which the electrostatic latent image is formed rotates, moves and sequentially passes a developing area Q2 and a transfer area Q4.

A developing device D that develops the electrostatic latent image in the developing area Q2 transports a developer to the developing area Q2 by a developing roll R0 to develop the electrostatic latent image on the image carrier PR passing the developing area Q2 to a toner image Tn as an example of a visible image.

In the transfer area Q4, a transfer roll TR as an example of a transfer device opposed to the image carrier PR is a member for transferring the toner image Tn on the surface of the image carrier PR to a sheet S as an example of a medium. A transfer voltage having a reverse polarity to the charged polarity of toner for development used in the developing device D is supplied to the transfer roll TR from a power circuit E. Applied voltages such as a charging voltage applied to the charging roll CR, a developing voltage applied to the developing roll R0 and a transfer voltage applied to the transfer roll TR and the power circuit E having a power source for a heater of a heating roll of a below-described fixing device F are controlled by the control part C.

In a lower part of the copying machine main body U1, a first sheet feed tray TR1 and a second sheet feed tray TR2 as an example of a sheet feed container are arranged in upper and lower parts in parallel.

In the upper end parts of the right end parts of the first sheet feed tray TR1 and the second sheet feed tray TR2, pick-up rolls Rp as an example of a sheet taking out member are arranged and the sheet S taken out by the pick-up roll Rp is transported to a separation member Rs.

The separation member Rs includes a feed roller Rs1 as an example of a sheet feed member and a retard roll Rs2 as an example of a separating member which come into pressure contact with each other. The sheets transported to the nipping part are separated one by one by the separation member Rs and transported to a sheet transport path SH1 an example of a medium transport path.

In the sheet transport path SH1, a transport roll Rb as an example of a transport member that may normally or reversely rotate is arranged. The sheet S transported to the sheet transport path SH1 is transported to an upper sheet transport path SH2 before transfer by the transport roll Rb that may normally and reversely rotate.

The sheet S transported to the sheet transport path SH2 before transfer is transported to a registration roll Rr as an example of a transfer area and transport time adjusting member by a transport toll Ra. Further, the sheet S fed from a manual sheet feed tray TR0 as an example of a manual sheet feed part is also transported to the registration roll Rr.

The sheet S transported to the registration roll Rr is transported to the transfer area Q4 from a sheet guide SG1 before transfer as an example of a medium guide member before transfer synchronously with a timing that the toner image Tn on the image carrier PR moves to the transfer area Q4.

The toner image Tn developed on the image carrier PR is transferred to the sheet S by the transfer roll TR in the transfer area Q4. After the toner image Tn is transferred to the sheet, the surface of the image carrier PR is cleaned by a cleaner CL1 as an example of a cleaner to remove remaining toner as an example of an adhering material and the surface of the image carrier PR is recharged by the charging roll CR.

The image carrier PR, the charging roll CR, the latent image writing device ROS and the developing device D form a toner image forming device G as an example of a visible image forming device. Further, in the first embodiment, the image carrier PR and the cleaner CL1 are formed as an integrally detachably attached and exchangeable image carrier unit PR+CL1, what is called a process cartridge relative to the image forming device U.

In a downstream side of a sheet transport direction of the transfer area Q4, a transferred sheet transport path SH3 is provided for transportation to a fixing area Q5 a recorded sheet S on which the toner image Tn is recorded in the transfer area Q4. The sheet S to which the toner image is transferred by the transfer roll TR in the transfer area Q4 is peeled off from the surface of the image carrier PR, guided by a sheet guide SG2 as an example of a transferred medium guide member of the transferred sheet transport path SH3 and transported to a fixing device F by a sheet transport belt BH as an example of a transferred medium transport member.

The fixing device F includes a heating roll Fh as an example of a heating and fixing member having a heater as a heat source in an inner past and a pressing roll Fp as an example of a pressing and fixing member. When the sheet S transported to the fixing device F passes the fixing area Q5 composed of the pressure contact area of the heating roll Fh and the pressing roll Fp, the toner image is thermally fixed to the sheet S and then the sheet S passes a sheet exit path SH4 and is transported to a sheet exit tray TRb as an example of a medium exit part.

In the sheet exit path SH4, a switching gate GT1 as an example of a transport path switching member is arranged in the downstream side of the fixing device F. The switching gate GT1 switches the transport direction of the sheet S passing the fixing device F either to the sheet exit tray TRh side or to a sheet reversing and connecting path SH5. The sheet reversing and connecting path SH5 connects an upstream end of the sheet exit path SH4, that is, a downstream side part of the fixing device F to the upward and downward sheet transport path SH1.

In the case of a double side copying operation, the one side recorded sheet S having the toner image recorded on a first surface is transported to the sheet reversing and connecting path SH5 by the switching gate GT2, passes a Mylar gate GT2 as an example of a transport direction regulating member and is sported to a sheet reversing path SH6 by the reverse rotation of the normally and reversely rotating and transport roll Rb. The sheet S transported to the sheet reversing path SH6 is transported to a reverse direction, what is called, switched back by the normal rotation of the normally and reversely rotating and transport roll Rb and transported again to the transfer area Q4 under a state that a front side and a back side are reversed.

Elements designated by the above-described symbols SH1 to SH6 form a sheet transport path SH as an example of the medium transport path.

The sheet tort path SH and the rollers Ra, Rb and Rr arranged therein and having sheet transport functions form a sheet transport device UA as an example of a medium transport device.

(Explanation of Cleaner)

Figure 2:
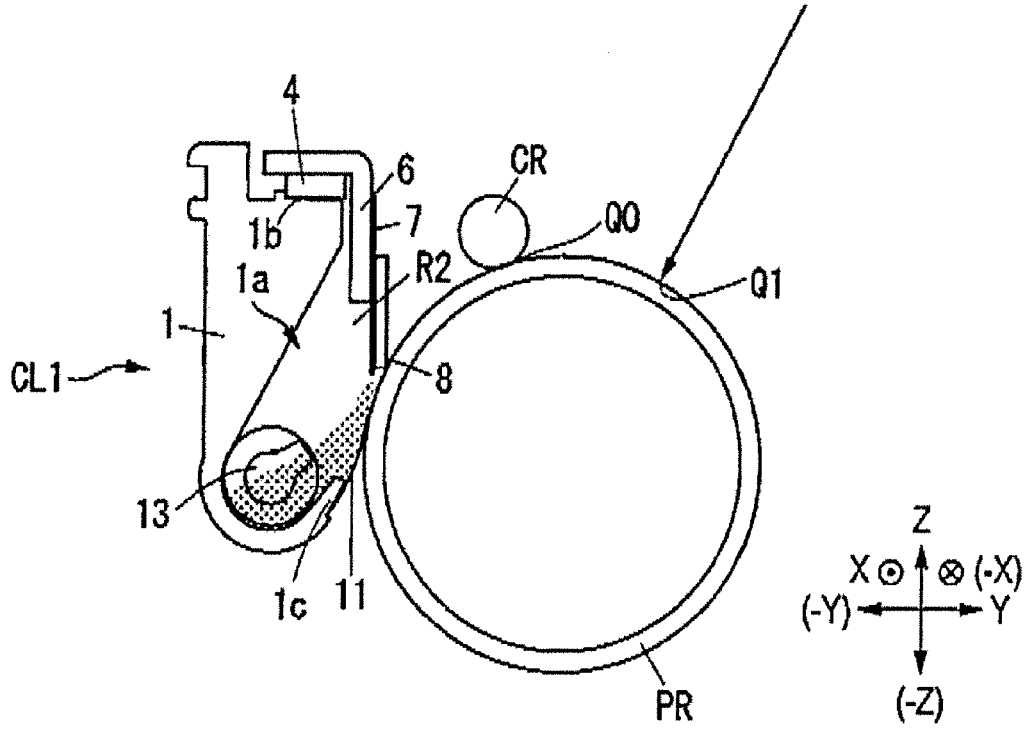
FIG. 2 is an enlarged view of main parts of a cleaner part of the first embodiment of the present invention.

FIG. 2 is an enlarged view of main parts of a cleaner part of the it embodiment of the present invention.

Figure 3:
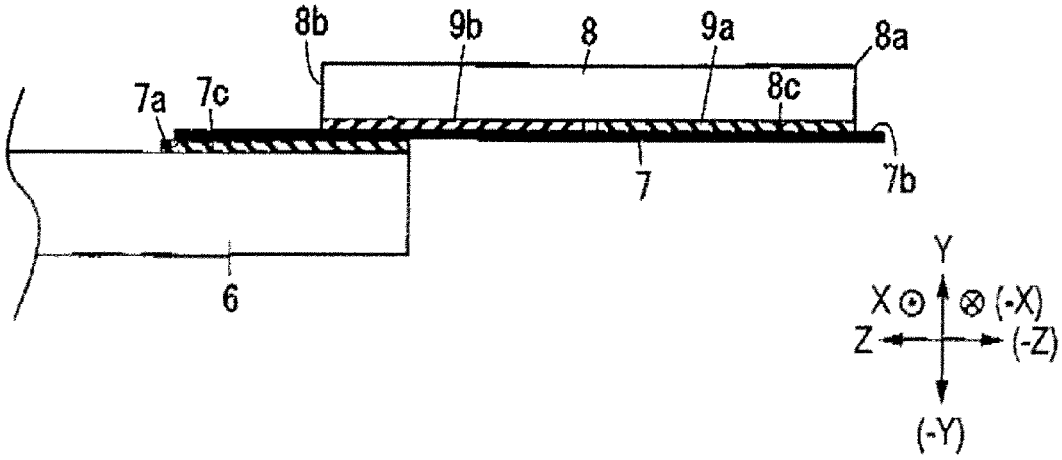
FIG. 3 is an enlarged view of main parts of a cleaning member of the first embodiment of the present invention.

FIG. 3 is an enlarged view of main parts of a cleaning member of the first embodiment of the present invention.

In order to easily understand an explanation, illustrations of members are suitably omitted in the drawing.

In FIGS. 1 and 2, the cleaner CL1 as the cleaner of the first embodiment of the present invention has a housing 1 as an example of a vessel. The housing 1 has an opening 1*a* to which the image carrier PR side is opened. On an upper end part of the housing 1, a cleaning member support part 1*b* is formed. In the image carrier PR side in the lower part of the housing 1, a leakage preventing member attaching member 1*c* is formed.

In the cleaning member support part 1*b*, an inverted L shaped holder 6 in section as an example of an attachment is supported by holding a seal member 4 as an example of a sealing member between the cleaning member support part 1*b* and the holder 6. The holder 6 of the first embodiment is screwed and fixed to the cleaning member support part 1*b*.

In FIGS. 2 and 3, on the surface of the holder 6 of the image carrier PR side, a thin plate shaped leaf spring 7 as an example of a supporting member is supported. The leaf spring 7 of the first embodiment has a surface 7*a* to be attached as an example of an attached surface formed in an upper end part of a left surface and a blade support surface 7*b* as an example of a supporting surface formed in a right surface. The surface 7*a* to be attached is fixed and supported to the holder 6 by an adhesive agent 7*c*. Accordingly, the part of the surface 7*a* to be attached serves as a base end part of the leaf sprig 7 and a lower end part as an example of one end portion serves as a free end part.

On the surge of the leaf spring 7 of the image carrier PR side, a cleaning blade 8 as an example of the cleaning part is supported. In the cleaning blade 8, a lower end part 8*a* forms a free end part as an example of one end portion and an upper end part 8*b* opposite thereto forms a base end part as an example of the other end portion. Then, the lower end part 8*a* of the cleaning blade 8 comes into contact with the surface of the image carrier PR to scrape out residual toner remaining on the surface of the image carrier PR. The cleaning blade 8 of the first embodiment has a surface 8*c* to be supported by the leaf spring formed as an example of a cleaning part by a surface of the leaf spring 7 side.

In FIG. 3, in the cleaner CL of the first embodiment, between the blade support surface 7*b* of the leaf spring 7 is bonded to the surface 8*c* of the cleaning blade 8 to be supported by the leaf spring by two kinds of adhesive agents. That is, in the lower end 8*a* side (a first portion) where the cleaning blade 8 comes into contact with the image carrier PR, the cleaning blade 8 is bonded to the leaf spring 7 by a first adhesive layer 9*a* formed with a first adhesive agent. Further, in the upper end 8*b* side (a second portion) of the surface 8*c* to be supported by the leaf spring, the cleaning blade 8 is struck to the leaf spring 7 by a second adhesive layer 9*b* whose hardness is lower than that of the first adhesive agent.

As the first adhesive agent, an adhesive agent whose adhesive strength is high in compression and expansion directions as the direction of thickness and a shearing direction as a shift direction may be used so that the cleaning blade 8 coming into contact with the image carrier PR is prevented from being peeled off from the leaf spring 7. For instance, a thermoplastic adhesive agent, what is called a hot melt adhesive agent may be used in which a solid adhesive agent of a thermoplastic resin component is heated and molten to apply a fluidity (hot melt), and cooled to be hardened and bonded and whose hardness is high, for instance, about 90° a Type-A durometer.

As the second adhesive agent, may be used an adhesive agent having an elasticity and an expansibility that may be deformed depending on the difference of deformation, that is, the difference of displacement along a shearing direction based on the difference of coefficient of thermal expansion between the cleaning blade 8 and the leaf spring 7 or a double sided adhesive tape. As the double sided adhesive tape, a usually well-known double sided adhesive tape may be used in which paste as an example of the adhesive agent is applied to both surfaces of a ground fabric such as a non-woven fabric or a resin thin film. The double sided adhesive tape is high in its adhesive strength in the direction of thickness, and is deformable depending on the difference of displacement along the shearing direction between the cleaning blade 8 and the leaf spring 7 due to the expansibility and elasticity of the paste or the ground fabric, namely, deformable so as to absorb the difference of displacement in the shearing direction. Accordingly, in the part of the second adhesive layer 9*b*, the relative shift, the movement or the deformation between the cleaning blade 8 and the leaf spring 7 may be absorbed by the second adhesive layer 9*b*.

In FIG. 2, to the leakage preventing member attaching member 1*c*, a film seal 11 as an example of a leakage preventing member is fixed and supported. The film seal 11 has a lower end part fixed to the surface of the leakage preventing member attaching member 1*c* through a double sided adhesive tape and comes into contact with the surface of the image carrier PR with a weak pressing force to prevent the residual toner scraped off and recovered by the cleaning blade 8 from leaking outside.

In the housing 1, a transport auger 13 as an example of a transport member for transporting the residual toner recovered to the housing 1 is arranged.

(Operation of First Embodiment)

In the cleaner CL1 of the image forming device U of the first embodiment of the present invention having the above-described structure, the cleaning blade 8 and the leaf spring 7 are bonded to each other by the first adhesive layer 9*a* having the high hardness in the free end part side in contact with the image carrier PR and by de second adhesive layer 9*b* having the low hardness in the base end part side. That is, the free end part of the cleaning blade 8 bonded by the first adhesive layer 9*a* is hardly peeled off from the leaf spring 7 during a frictional contact when the free end part of the cleaning blade 8 removes the developer from the image carrier PR. Further, in the base end part of the cleaning blade 8 bonded by the second adhesive layer 9*b* deformed so as to absorb the shift in the shearing direction, when the cleaning blade 8 is shifted in the shearing direction relative to the leaf spring 7, the displacement in the shearing direction is absorbed.

Figure 4A:
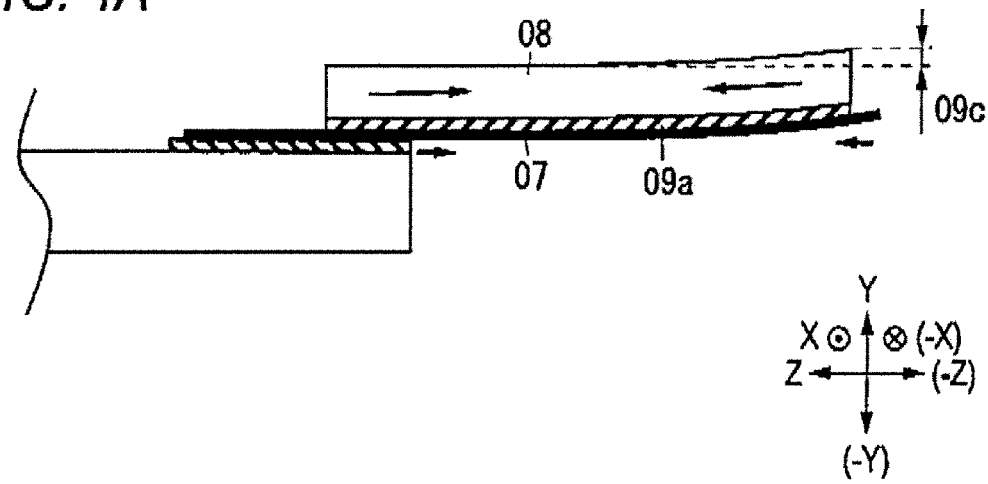
FIG. 4A is an explanatory view of the deformation of the related leaf spring and the cleaning blade at the time of a low temperature and low humidity.
Figure 4B:
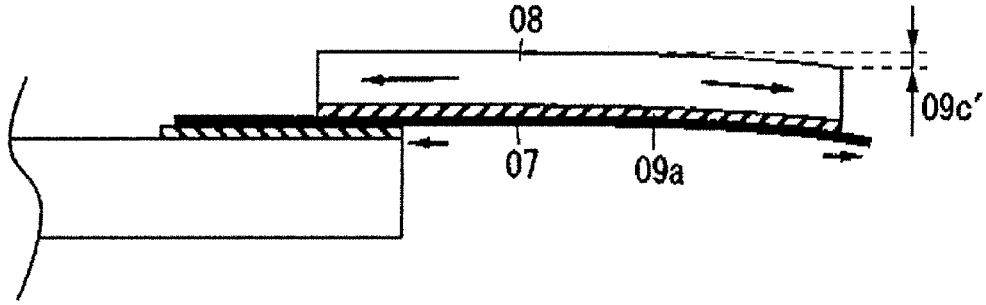
FIG. 4B is an explanatory view of the deformation of the related leaf spring and the cleaning blade at the time of a high temperature and high humidity.

FIG. 4 is an explanatory view of a related cleaner in which a cleaning blade is bonded to a leaf spring FIG. 4A is an explanatory view of the deformation of the leaf spring ad the cleaning blade at the time of a low temperature and low humidity. FIG. 4B is an explanatory view of the deformation of the leaf spring and the cleaning blade at the time of a high temperature and high humidity.

In FIG. 4, in the related cleaner, the cleaning blade and the leaf zing are ordinarily bonded to each other only by one kind of adhesive agent. A structure may be adopted in which the leaf spring 07 and the cleaning blade 08 are bonded to each other only by a hot met adhesive agent 09*a* from the viewpoint of strength or durability.

In FIG. 4A, in the related structure, when an environment of the temperature and the humidity has low temperature and low humidity, if a coefficient of thermal expansion of the leaf spring 07 made of metal is higher than a coefficient of thermal expansion of the cleaning blade 08 made of rubber, an amount of shrinkage of the cleaning blade 08 made of the rubber is larger than that of the leaf spring 07 due to the difference in the coefficient of thermal expansion under the environment of the low temperature and low humidity as shown in FIG. 4A. At this time, since a boundary part between the cleaning blade 08 and the leaf spring 07 is bonded by the hot melt adhesive agent in which a shift in the shearing direction is not absorbed, a free end side of the leaf spring 07 is deformed so as to be curved nearer to an image carrier PR due to the difference in the amount of shrinkage. Consequently, when an amount of bite 09*c* related to a contact pressure under which the cleaning blade 08 comes into contact with the image carrier PR is larger than that obtained when a change does not arise by an environment and, accordingly, a deformation does not arise, that is, a case of ordinary temperate and ordinary humidity, so that the contact pressure under which the cleaning blade 08 comes into contact with the image carrier PR is increased. Thus, an abrasion of the image carrier may be accelerated to shorten a life or a curvature or noise of the cleaning blade 08 may be increased.

In FIG. 4B, under the environment of the high temperature and high humidity in the related structure, on the contrary to the case shown in FIG. 4A, an amount of extension of the cleaning blade 08 made of the rubber is increased, and the free end side of the leaf spring 07 is deformed to be curved in the direction separating from the image carrier PR by the hot melt adhesive agent in which the shift in the shearing direction is not absorbed. Accordingly, an amount of bite 09*c*' is decreased, so that the contact pressure under which the cleaning blade 08 comes into contact with the image carrier PR is weakened. Thus, cleaning characteristics as a capability for removing a developer may be deteriorated to deteriorate an image quality.

Namely, in the structure in which the cleaning blade and the leaf spring are bonded to each other only by the hot melt adhesive agent shown in FIG. 4, an environmental variation of the cleaning blade 08 is increased.

Figure 5:
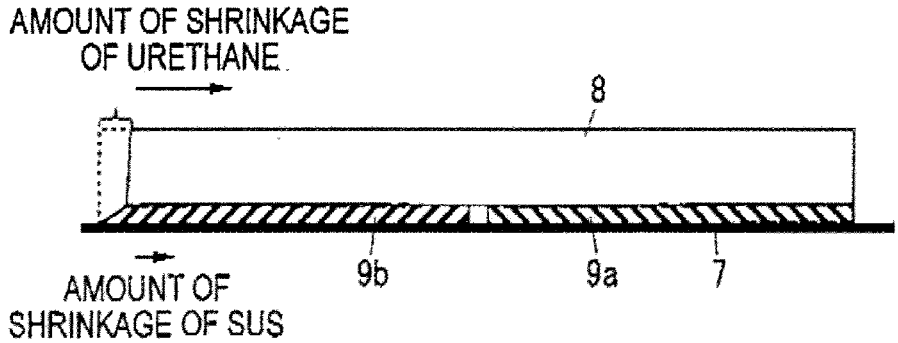
FIG. 5 is an explanatory view of the cleaner of the first embodiment and the deformation of the leaf spring and the cleaning blade during the low temperature and low humidity.

FIG. 5 is an explanatory view of the cleaner of the first embodiment and the deformation of the leaf spring and the cleaning blade during the low temperature and low humidity.

In the first embodiment, the deformation in the shearing direction is absorbed by the second adhesive layer 9*b*.

Accordingly, even when a difference in an amount of expansion arises between the cleaning blade 8 and the leaf spring 7, the different in the amount of expansion is supposed to be absorbed by the second adhesive layer 9*b* as shown in FIG. 5. Consequently, the curvature and warpage of the leaf spring 7 and the cleaning blade 8 may be more reduced than those of the related structure shown in FIG. 4, and the variation of the contact pressure between the cleaning blade 8 and the image carrier PR is more reduced. Therefore, in the cleaner CL1 of the first embodiment, a phenomenon is reduced that an abrasion of the image carrier PR is accelerated to shorten a life, a curvature or noise of the cleaning blade 8 is increased or cleaning characteristics are deteriorated.

Figure 6A:
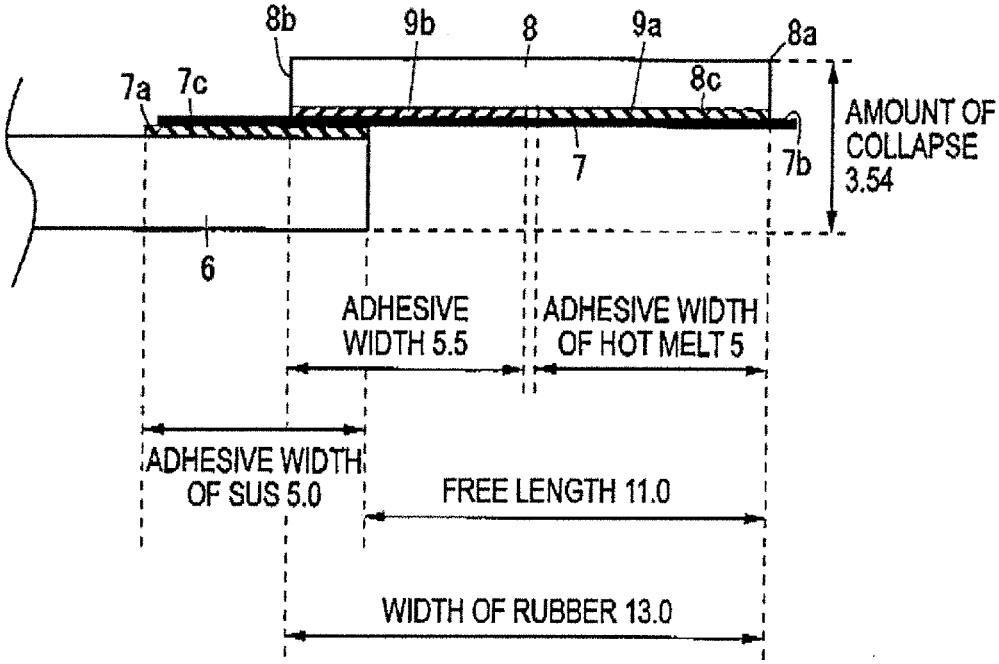
FIG. 6A is an explanatory view of dimensions of a cleaning blade, a leaf spring and an adhesive layer of the example of the first embodiment.
Figure 6B:
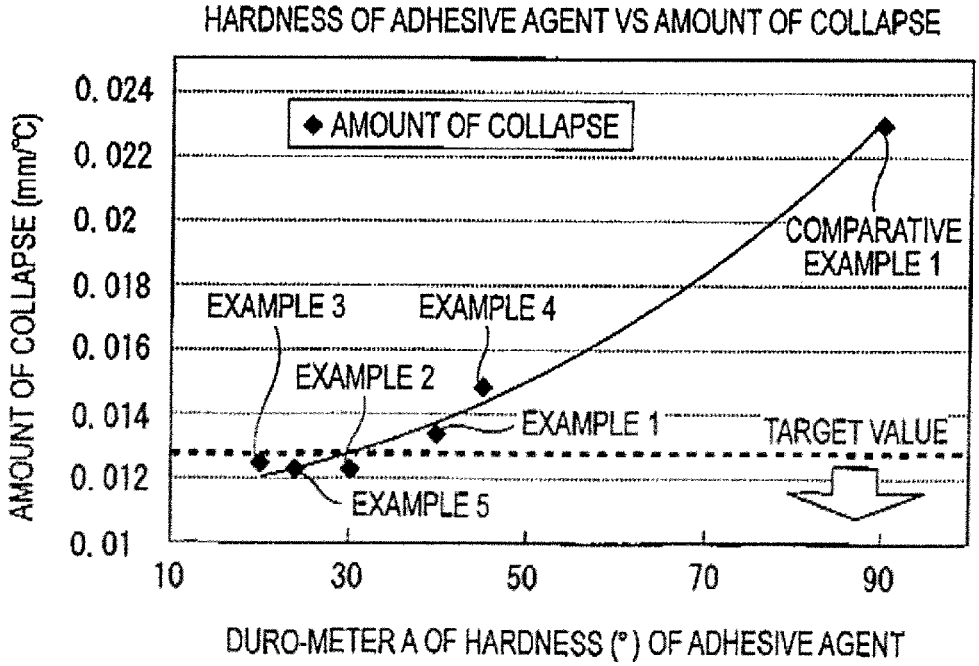
FIG. 6B is an explanatory view of experiment results of the first embodiment by showing the hardness of an adhesive agent in an axis of abscissas and a change of an amount of collapse in an axis of ordinates.

FIG. 6 is an explanatory view of an example of the first embodiment. FIG. 6A is an explanatory view of dimensions of a cleaning blade, a leaf spring and an adhesive layer of the example. FIG. 6B is an explanatory view of experiment results by showing the hardness of an adhesive agent in an axis of abscissas and a change of an amount of collapse in an axis of ordinates.

EXAMPLE

Example 1

Referring to FIG. A, in an example 1, as the leaf spring 7, SUS: Stainless Used Steel as an example of a metal material is used and a thin plate type having the thickness of 0.08 mm and the length of 16.0 mm is used. Further, as the cleaning blade 8, urethane rubber is used as an example of a resin material and a plate type having the thickness of 1.2 mm and the length of 13.0 mm is used. Further, a width in which the leaf spring 7 is bonded to the holder 6 is set to 5.0 mm and a deformable free length of the leaf spring 7 is set to 11.0 mm. The amount of collapse as the length from an inner surface of the holder 6 having the thickness of 2.0 mm to the outer surface of the cleaning blade 8 of the image carrier PR side is set to 3.54 mm. Further, the width of the first adhesive layer 9*a* is 5 mm and, the width of the second adhesive layer 9*b* is set to 5.5 mm. A very small gap is provided between the first adhesive layer 9*a* and the second adhesive layer 9*b* so that the adhesive agents are not mixed with each other.

The leaf spring 7 is fixed to the holder 6 by a hot melt adhesive agent as an example of an adhesive agent. As the hot melt adhesive agent, for instance, HM 321 produced by Cemedine Co., Lt. may be used.

Further, in the example 1, as the first adhesive layer 9*a*, the same hot melt adhesive agent as that by which the leaf spring 7 is bonded to the holder 6 is used and applied with the thickness of 0.13 mm and the width of 5 mm.

Further, as the second adhesive layer 9*b*, Cemedine Super X produced by Cemedine Co., Ltd. is used as an adhesive agent having an elasticity, and the width is set to 5.5 mm and the thickness is set to 0.13 mm similarly to the first adhesive layer 9*a*.

Example 2

In an example 2, as the second adhesive layer 9*b*, Sinetsu Silicone KE45 produced by Shin-Etsu Chemical Co., Ltd, is used as a adhesive agent having elasticity, and other parts are set similarly to the example 1.

Example 3

In an example 3, as the second adhesive layer 9*b*, Sinetsu Silicone KE-3423 produced by Shin-Etsu Chemical Co., Ltd, is used as an adhesive agent having elasticity, and other parts are set similarly to the example 1.

Example 4

In an example 4, as the second adhesive layer 9*b*, Sinetsu Silicone KE-3498 produced by Shin-Etsu Chemical Co., Ltd., is used as an adhesive agent having elasticity, and other parts are set similarly to the example 1.

Example 5

In an example 5, as the second adhesive layer 9*b*, Sinetsu Silicone KE-3427 produced by Shin-Etsu Chemical Co., Ltd., is used as an adhesive agent having elasticity, and other parts are set similarly to the example 1.

Example 6

In an example 6, as the second adhesive layer 9*b*, DIC#8003D produced by Dainippon Ink and Chemicals, Inc. as a double sided adhesive tape is used and other parts are set similarly to the example 1.

Example 7

In an example 7, as the second adhesive layer 9*b*, No. 500 produced by Nitto Electric Industrial Co., Ltd. as a double sided adhesive tape is used and other parts are set similarly to the example 1.

Example 8

In an example 8, as the second adhesive layer 9*b*, No. 5000 produced by Nitto Electric Industrial Co., Ltd. as a double sided adhesive tape is used and other parts are set similarly to the example 1.

Comparative Example 1

In a comparative example 1, the entire part of a boundary of 13 mm between the cleaning blade 8 and the leaf spring 7 is bonded by a hot melt adhesive agent like the related structure.

(Results)

In the examples 1 to 8 and the comparative example 1 respectively, the change of an amount of collapse in an environment of low temperature and low humidity of 10° C. and 15% RH is measured relative to ordinary humidity and ordinary temperature of 22° C. and 55% RH. Experiment results are shown in FIG. 6B.

In FIG. 6B, in the example 1, the hardness is 40° in a Type-A durometer and the change of the amount of collapse is 0.0149 mm/° C.

In the example 2, the harness is 30° in a Type-A durometer and the change of the amount of collapse is 0.0123 mm/° C.

Tn the example 3, the hardness is 20° in a Type-A durometer and the change of the amount of collapse is 0.0125 mm/° C.

In the example 4, the hardness is 45° in a Type-A durometer and the change of the amount of collapse is 0.0149 mm/° C.

In the example 5, the hardness is 24° in a Type-A durometer and the change of the amount of collapse is 0.0123 mm/° C.

In the example 6, the change of the amount of collapse is 0.005 mm/° C.

In the example 7, the change of the amount of collapse is 0.008 mm/° C.

In the example 8, the change of the amount of collapse is 0.006 mm/° C.

In the double sided adhesive tapes of the examples 6 to 8, there is no data of the hardness, which is different from the adhesive agents of the examples 1 to 5, however, the double sided adhesive tapes are sufficiently soft and the hardness thereof is low as compared with the hot melt adhesive agent.

In the comparative example 1, the hardness is 90° in a Type-A durometer and the change of the amount of collapse is about 0.023 min/° C.

Accordingly, it is recognized from the results of the examples 1 to 5 and the comparative example 1 respectively that when the adhesive agent having a lower hardness is used in the second adhesive layer 9*b*, the change of the amount of collapse is the more reduced, and even when the environmental change of the temperature and humidity occurred, the change of a contact pressure is reduced. Especially, it is understood that when a target value of the change of the amount of collapse is set to 0.0125 mm/° C. or lower, the adhesive agent whose hardness is 30 or lower by the Type-A durometer might be used.

Further, it is recognized from the results of the examples 6 to 8 that when the double sided adhesive tapes are used, the change of the amount of collapse is decreased and the change of the contact pressure is reduced.

(Modifications)

The embodiment of the present invention is described above in detail, however, the present invention is not limited to the above-described embodiment and various changes may be made within a scope of the gist of the present invention. Modifications (H01) to (H04of the present invention will be described below.

(H01) In the above-described embodiment, the present invention is not limited to the copying machine as an example of the image forming device and may be applied to an image forming device such as a printer, a facsimile device, etc. Further, the present invention is not limited to a single color, what is called a monochromatic image forming device, and may be applied to a multiple color, what is called a color image forming device.

(H02) In the above-described embodiment, as the cleaner, is exemplified the cleaner for cleaning the surface of the image carrier PR as a member to be cleaned, however, the present invention is not limited thereto and may be applied to a cleaner of the transfer roll TR or a cleaner of the charging roll CR. Further, in the color image forming device, the present invention may be applied to a cleaner for cleaning a belt shaped or a dr shaped intermediate transfer member.

(H03) In the above-described embodiment, the gap is formed between the first adhesive layer 9*a* and the second adhesive layer 9*b*, however, when the adhesive agents may be avoided from being mixed with each other in production, the gap may be eliminated.

(H04) In the above-described embodiment, exemplified numerical values or specific materials may be arbitrarily changed depending on a design or a specification.

The foregoing description of the exemplar embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a cleaning part whose one end portion comes into contact with a surface of an image carrier; and a supporting part that supports the cleaning part and applies a force for pressing the one end portion of the cleaning part to the surface of the image carrier, wherein a surface of a first portion including the one end portion of the cleaning part is bonded to the supporting part with a first adhesive layer, and a surface of a second portion including the other end portion opposite to the one end portion of the cleaning part is bonded to the supporting part with a second adhesive layer having a Type-A durometer hardness which is lower than that of the first adhesive layer.

2. A cleaning member comprising:

a cleaning part whose one end portion comes into contact with a surface of an image carrier; and a supporting part that supports the cleaning part and applies a force for pressing the one end portion of the cleaning part to the surface of the image carrier, wherein a surface of a first portion including the one end portion of the cleaning part is bonded to the supporting part with a first adhesive layer, and a surface of a second portion including the other end portion opposite to the one end portion of the cleaning part is bonded to the supporting part with a second adhesive layer which is deformed in accordance with a difference in displacement in a shearing direction based on a difference in coefficient of thermal expansion between the cleaning part and the supporting part.

3. A cleaner comprising:

a cleaning part having one end portion that comes into contact with a surface of an image carrier;

a vessel that accommodates developer removed by the one end portion of the cleaning part from the surface of the image carrier;

an attachment provided to the vessel;

a supporting part that supports the cleaning part and applies a force for pressing the one end portion of the cleaning part to the surface of the image carrier, the supporting part being connected to the vessel by the attachment, wherein a surface of a first portion including the one end portion of the cleaning part is bonded to the supporting part with a first adhesive layer, and a surface of a second portion including the other end portion opposite to the one end portion of the cleaning part is bonded to the supporting part with a second adhesive layer having a Type-A durometer hardness which is lower than that of the first adhesive layer.

4. The cleaner according to claim 3, wherein the first adhesive layer comprises a hot melt adhesive and the second adhesive layer comprises a double sided adhesive tape.

5. The cleaner according to claim 3, wherein the attachment is provided as a part of the vessel.

6. The cleaner according to claim 3, wherein the attachment is provided as a separate member from the vessel.

7. An image carrier unit comprising:

an image carrier that carries an image formed with developer on a surface thereof; and the cleaner according to claim 3 that removes the developer remaining on the surface of the image carrier.

8. An image forming device comprising:

an image carrier;

a charger that charges a surface of the image carrier;

a latent image writing device that writes a latent image on the surface of the image carrier;

a developing device that develops the latent image on the surface of the image carrier with developer to form a visible image;

a transfer device that transfers the visible image on the surface of the image carrier to a surface of a receiving member; and the cleaner according to claim 3 that removes the developer remaining on the surface of the image carrier after the visible image is transferred.

9. A cleaner comprising:

a cleaning part having one end portion that comes into contact with a surface of an image carrier;

a vessel that accommodates developer removed by the one end portion of the cleaning part from the surface of the image carrier;

an attachment provided to the vessel;

a supporting part that supports the cleaning part and applies a force for pressing the one end portion of the cleaning part to the surface of the image carrier, the supporting part being connected to the vessel by the attachment, wherein a surface of a first portion including the one end portion of the cleaning part is bonded to the supporting part with a first adhesive layer, and a surface of a second portion including the other end portion opposite to the one end portion of the cleaning part is bonded to the supporting part with a second adhesive layer which is deformed in accordance with a difference in displacement in a shearing direction based on a difference in coefficient of thermal expansion between the cleaning part and the supporting part.

10. The cleaner according to claim 9, wherein the first adhesive layer comprises a hot melt adhesive and the second adhesive layer comprises a double sided adhesive tape.

11. The cleaner according to claim 9, wherein the attachment is provided as a part of the vessel.

12. The cleaner according to claim 9, wherein the attachment is provided as a separate member from the vessel.

13. An image carrier unit comprising:

an image carrier that carries an image formed with developer on a surface thereof; and the cleaner according to claim 9 that removes the developer remaining on the surface of the image carrier.

14. An image forming device comprising:

an image carrier;

a charger that charges a surface of the image carrier;

a latent image writing device that writes a latent image on the surface of the image carrier;

a developing device that develops the latent image on the surface of the image carrier with developer to form a visible image;

a transfer device that transfers the visible image on the surface of the image carrier to a surface of a receiving member; and the cleaner according to claim 9 that removes the developer remaining on the surface of the image carrier after the visible image is transferred.

* * * * *